United States Patent [19]

Nolden

[11] Patent Number: 4,508,011

[45] Date of Patent: Apr. 2, 1985

[54] HYDRAULIC AXIAL PISTON MACHINE

[75] Inventor: Wilhelm Nolden, Wiesbaden, Fed. Rep. of Germany

[73] Assignee: Abex Corporation, Stamford, Conn.

[21] Appl. No.: 480,167

[22] Filed: Mar. 29, 1983

[30] Foreign Application Priority Data

Apr. 2, 1983 [DE] Fed. Rep. of Germany ..... 3212402
Apr. 2, 1983 [DE] Fed. Rep. of Germany ..... 3212374
Apr. 2, 1983 [DE] Fed. Rep. of Germany ..... 3212429

[51] Int. Cl.[3] ..... F01B 3/00; F01B 13/04; F04B 1/26

[52] U.S. Cl. ..... 91/506; 417/222

[58] Field of Search ..... 91/504, 505, 506, 499; 92/12.2; 417/218, 222

[56] References Cited

U.S. PATENT DOCUMENTS 3,274,948 9/1966 Baits ..... 91/506
3,406,608 10/1968 Diedrich ..... 91/506 X

FOREIGN PATENT DOCUMENTS 1653385 8/1970 Fed. Rep. of Germany ..... 91/506
2647139 4/1978 Fed. Rep. of Germany ..... 91/505

*Primary Examiner*—Edward K. Look
*Attorney, Agent, or Firm*—Mueller and Smith

[57] ABSTRACT

A hydraulic axial piston machine is provided which has a swash plate mounted on a yoke which pivots about the axis of a pair of trunnions. The back surface of the yoke is curved and is supported on the surface of a flat, rigid rotary plate which is displaced linearly as the yoke is pivoted. The rotary plate is supported on a pair of roller bearings which are mounted on a resilient damping plate.

12 Claims, 8 Drawing Figures

HYDRAULIC AXIAL PISTON MACHINE

BACKGROUND OF THE INVENTION

This invention relates to a hydraulic, variable displacement, axial piston machine. More particularly, it relates to an improved means for damping vibration producing forces within the machine which includes an improved means for mounting a pivoting yoke which supports a swash plate.

Variable displacement axial piston machines in which the swash plate is mounted on a pivoting yoke are well known. In such a machine it is common for the yoke pivots to absorb all of the hydraulic forces generated during operation of the machine, i.e., the axial and radial forces. The yoke pivots may be mounted in antifriction bearings or have hydrostatic bearings.

Among the problems with antifriction bearings are, they are expensive and due to bearing clearance requirements and the resulting concentrated load on the outer ring, they cannot be utilized in accordance with their theoretical static load capacity. This necessitates the use of a larger, more expensive bearing. Additionally, the vibrations from and the forces of the machine lead to premature material fatigue in the rolling contact zone unless the bearings are oversized with respect to service life.

Hydrostatic bearings for yoke pivots are disadvantageous in that they leak fluid, have widely varying friction ratios and require relatively high adjusting forces which, in turn, lead to more costly control devices for adjusting the yoke.

It is desirable to provide a variable displacement, axial piston machine in which the pivots for the yoke do not absorb the forces which act on the swash plate and in which vibrations are damped or otherwise reduced to thereby reduce the size and cost of pump components and increase the life of the pump.

SUMMARY OF THE INVENTION

The instant invention provides a variable displacement, axial piston machine having a swash plate supported on a yoke which is slidably connected to a pair of trunnion pivots, such that forces applied to the swash plate are not transmitted to the pivots. Forces applied to the swash plate are transmitted through the yoke which has a curved back surface and are absorbed by a flat, rotary disc in contact with the curved surface. The rotary disc uniformly distributes the load applied to it to a pair of linear roller bearings which are supported on a damping plate mounted in the machine housing. This reduces the amount of vibration transmitted from the swash plate to the housing.

DESCRIPTION OF THE PREFERRED EMBODIMENT

Figure 1:
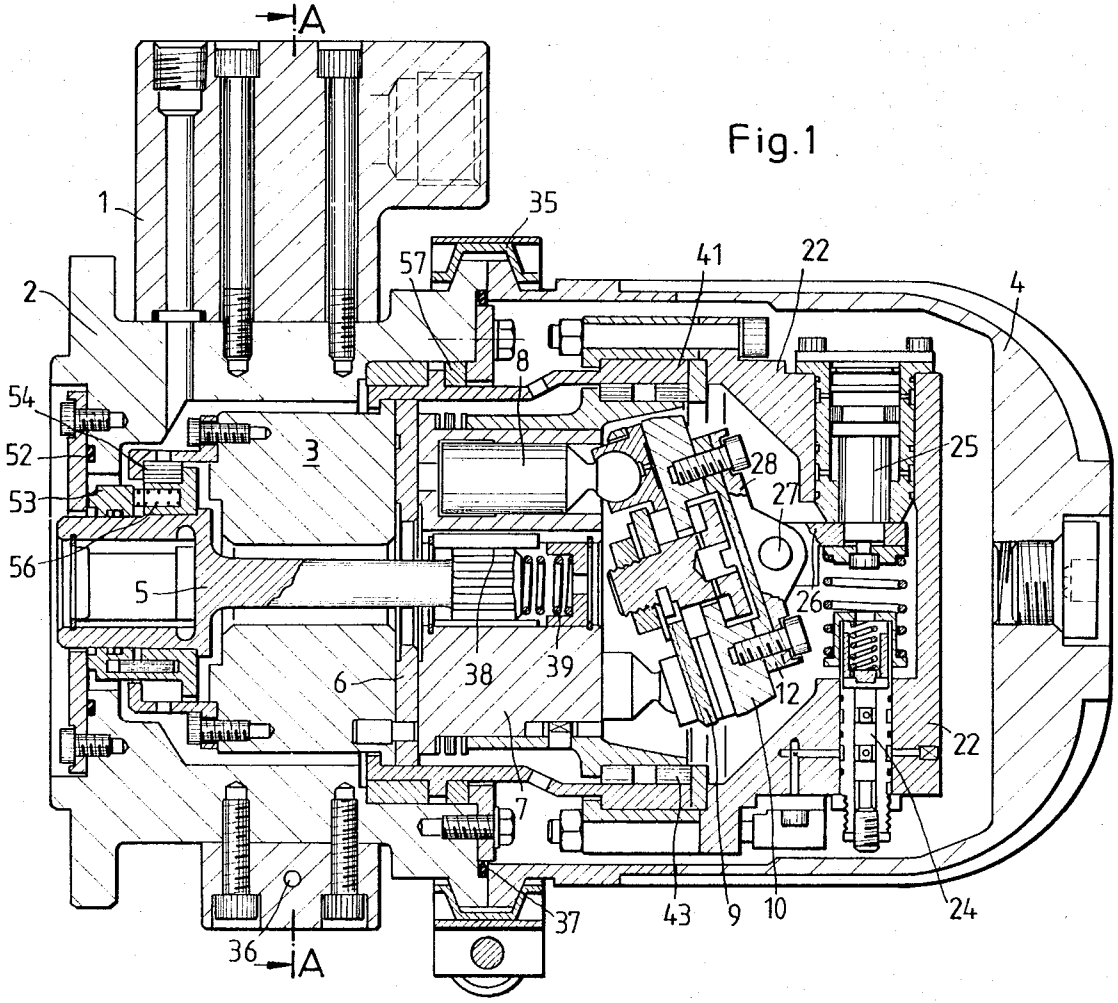
FIG. 1 is a longitudinal cross-section through an axial piston machine according to the instant invention.
Figure 2:
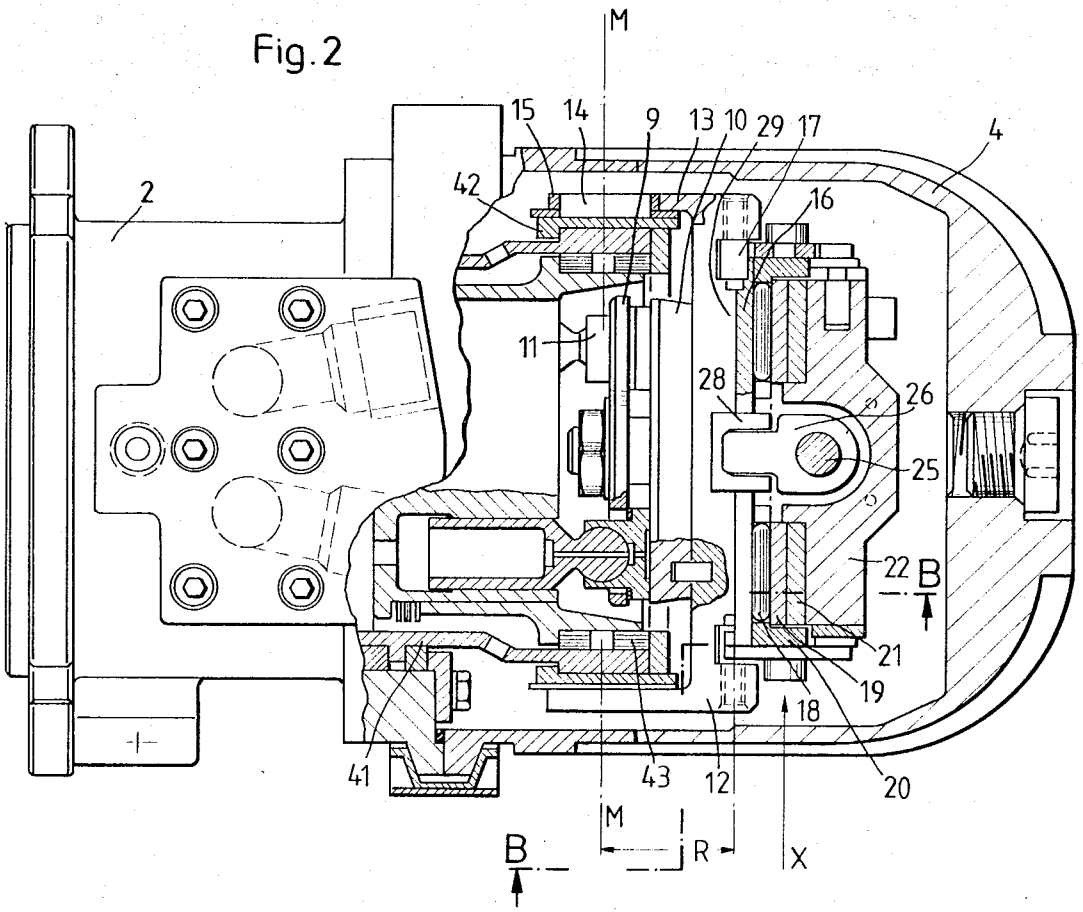
FIG. 2 is a longitudinal cross-section through the machine of FIG. 1, rotated 90 degrees.
Figure 3:
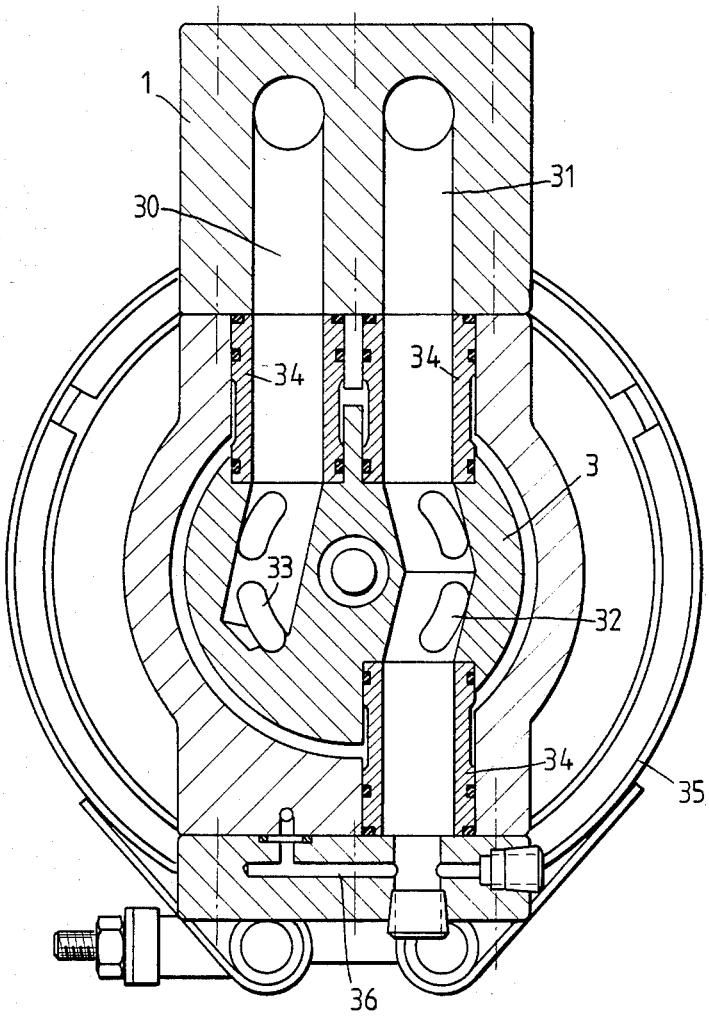
FIG. 3 is a cross-section along line A—A of FIG. 1.

Referring to FIGS. 1–3, the axial piston machine of the instant invention has a housing 2 which is connected to a manifold 1 for the fluid inlet and exhaust lines by bolts.

A port block 3, to which is fastened a port plate 6, is rigidly mounted in one end of housing 2. One end of a drive shaft 5 passes through the port block and the port plate and engages the splined inner bore of a sleeve 38. Sleeve 38 has an outer splined surface which engages a complementary, splined, central, inner bore of a barrel 7. Sleeve 38 is constructed from a resilient material, such as plastic, to reduce or dampen any vibrations which are transmitted to the barrel from the shaft. A helical spring 39 biases the splined end of shaft 5 into engagement with sleeve 38.

The opposite end of drive shaft 5 is supported in a slide bearing 54 and projects through an end cover 52. A seal 53, which is rotated by shaft 5 through a pin, is mounted on the shaft between the bearing and the cover to prevent fluid leakage.

Barrel 7 has a plurality of equally spaced, circumferentially arranged pistons 8, each having one end which sucks low pressure fluid in from a fluid inlet connected to port plate 6 and exhausts fluid at high pressure through port plate 6 into a fluid outlet as the barrel rotates. The other end of each piston 8 has a shoe 11 which is held against a swash plate 10 by a hold-down assembly 9. When swash plate 10 is perpendicular with respect to the axis of barrel 7, the pistons do not reciprocate when barrel 7 is rotated and hence no fluid is displaced. The swash plate is in a position of minimum fluid displacement. When swash plate 10 is not perpendicular to the axis of barrel 7, the pistons reciprocate and displace fluid as the barrel is rotated. The greatest angle of swash plate 10 from perpendicular to the barrel axis provides maximum fluid displacement. An outer spring cap 4 fits over the barrel and swash plate end of the machine and is attached to housing 2 by a strap 35. The inner surface of cap 4 has a coating of a damping material, such as plastic, to reduce the amount of noise transmitted when the machine is operating. A gasket 37 prevents leakage between the cap and the housing.

A housing for the barrel 7 of the pump is formed by a central tube 41 which is bolted to main pump housing 2. A pair of plastic damping rings 57 are interposed between tube 41 and housing 2 to reduce the transmittal of vibration therebetween. In addition to supporting barrel 7, tube 41 supports a trunnion ring 42 which guides pivotal movement of swash plate 10 and a control base 22 which houses a control piston for a yoke which supports the swash plate, as described hereinafter. From the above, it can be seen that central tube 41 must absorb the hydraulic and mechanical forces imposed on the swash plate and the tilting ring.

Barrel 7 is slidably received in a sleeve 45 which, in turn, is mounted in a bearing ring 43 mounted within tube 41. Bearing ring 43 is essentially a freefloating, plain bearing. A pin 46, shown in FIG. 6, prevents relative rotary movement between the sleeve and the barrel. Sleeve 45 can move axially with respect to barrel 7. A plurality of corrugated springs 47, best seen in FIGS. 6 and 8, act between barrel 7 and sleeve 45 to provide an axial force which biases barrel 7 in one direction against port plate 6 and biases sleeve 45 in the other direction against bearing ring 43 to load the bearing ring against a thrust ring 49. The mean resultant lateral force of all the pistons 8 loaded on the delivery side of the pump is directed radially, i.e., in the direction of arrow Z shown in FIG. 6, and centrally loads bearing ring 43.

Figure 6:
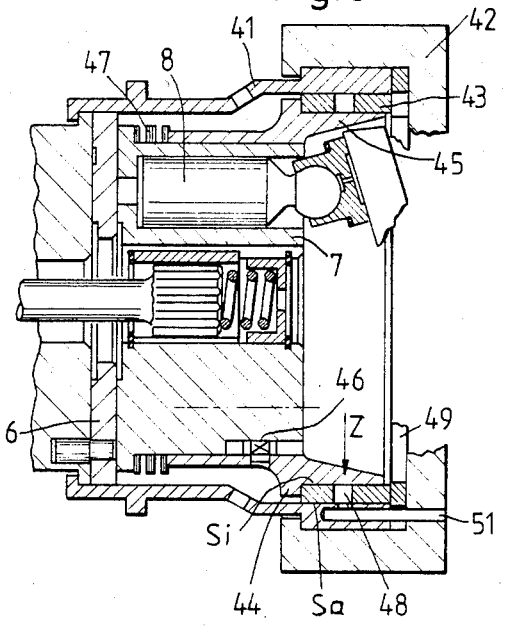
FIG. 6 is a detail from the section of FIG. 1.
Figure 8:
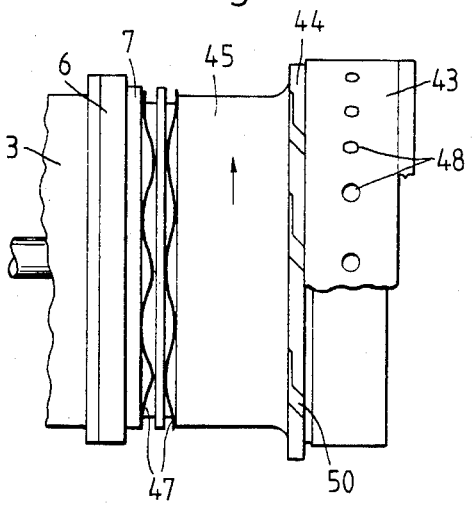
FIG. 8 is a side view corresponding to FIG. 6.
Figure 7:
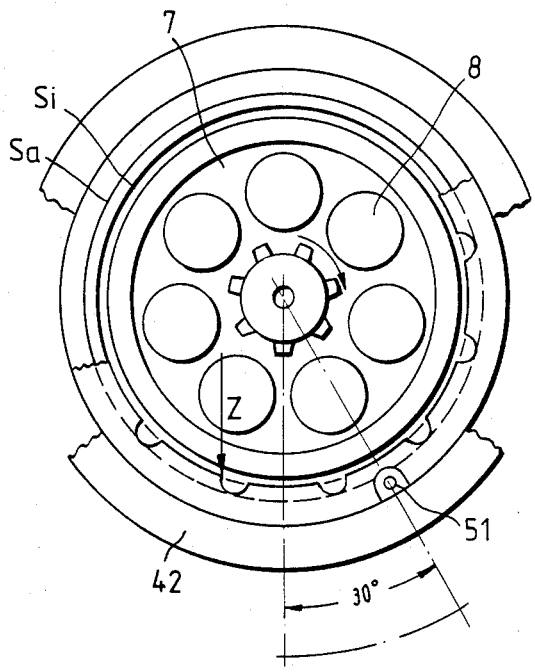
FIG. 7 is an end view of FIG. 6.

Referring to FIGS. 6–8, bearing ring 43 has a plurality of radial lubrication holes 48. An inner lubrication gap Si is formed between bearing ring 43 and sleeve 45 and an outer lubrication gap Sa is formed between bearing ring 43 and tube 41. High pressure oil from the outlet, of the machine is supplied to a line 51 which is connected to lubrication holes 48. This oil provides heavyduty, hydrodynamic oil pressure films in lubrication gaps Si and Sa. A plurality of lubricating ducts 50 are formed on a collar 44 of sleeve 45 to provide a load bearing, hydrodynamic lubrication film on the lateral face of bearing ring 43 adjacent thrust ring 49. The ducts 50 slope forwardly in the direction of sleeve rotation and also supply churned oil from within the pump housing to the side of ring 43 adjacent sleeve 45.

It is apparent that central tube 41 and thrust ring 49 are stationary and that barrel 7 and sleeve 45 mounted in bearing ring 43 rotate at the speed of drive shaft 5 with respect thereto. Due to the viscous liquid friction in lubricating gaps Si and Sa, there is drag moment in operation on bearing ring 43, so that under normal operating conditions (approximately 100 degrees C.) the bearing ring rotates at about half the speed of shaft 5.

In the instant machine the swash plate 10 is pivotally mounted such that, when it is pivoted about a transverse axis, a variable piston stroke is obtained. Referring to FIGS. 1, 2, 4 and 5, it can be seen that swash plate 10 is bolted to a tilting yoke 12. Yoke 12 has a pair of guide arms 13 each slidably engaged with a slide ring 15 which is rotatably mounted on a trunnion 14 on trunnion ring 42. Thus, yoke 12 pivots about the axis M—M of the trunnions but it is free to move radially with respect to axis M—M. The rear surface of yoke 12 is curved and has a radius such that, when the yoke is pivoted about trunnion axis M—M, friction between the rear surface and a rotary disc 16 engaged by the surface causes linear movement of the disc. The friction is caused by the high axial hydraulic forces the pistons encounter as they traverse the pressure zone. Generally, the center of the radius of curvature of the curved back surface lies on trunnion axis M—M. Axis M—M also bisects bearing ring 43 laterally.

Rotary disc 16 is supported on two linear roller bearings 18 which roll on fixed plates 19. Each bearing 18 has a cage 20 which spaces the linear roller bearings in the manner of a frame, prevents free play between the rollers and secures the position of the bearing 18. The fixed plates 19 rest on plastic damping plates 21 which are secured in spaces formed in fixed control base 22. Control base 22 is bolted to trunnion ring 4.

Figure 4:
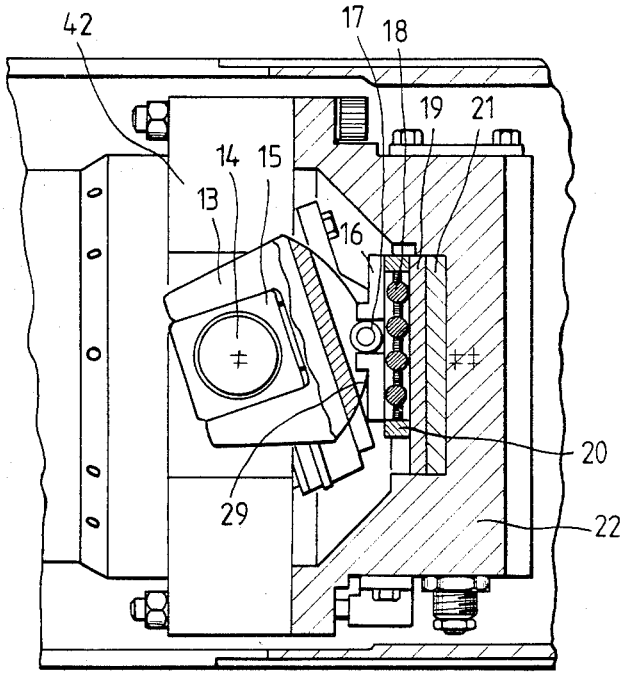
FIG. 4 is a partial section taken along line B—B of FIG. 2.

It should be noted that yoke 12 is coupled to rotary disc 16 by means of a pair of grooves and rollers 17 best shown in FIGS. 2 and 4. The rollers are mounted in a pair of grooves formed in the back surface of yoke 12 and roll in retaining grooves formed in disc 16.

Figure 5:
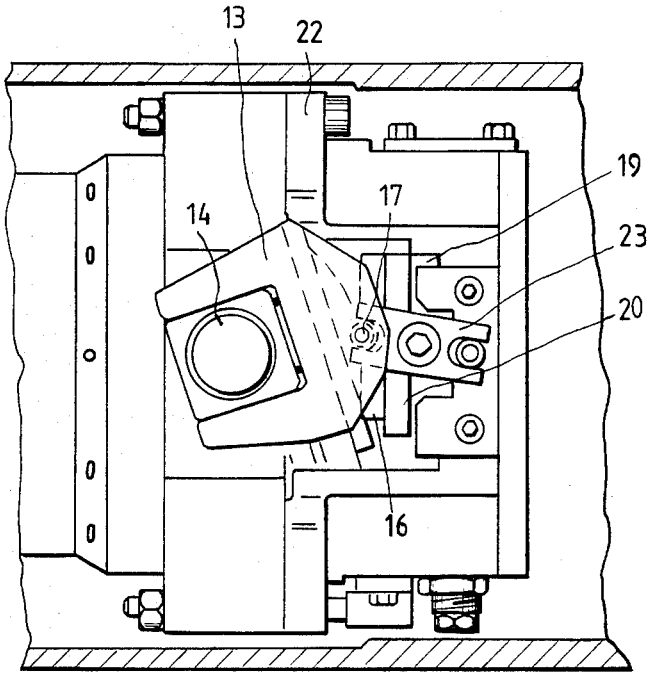
FIG. 5 is a view looking in the direction of arrow X in FIG. 2.

Bearings 18 are kept properly aligned with the rear surface of yoke 12 by a pair of rotatable cover plates 23, one of which is bolted to the outside of each cage 20, as best seen in FIG. 5. One end of each cover plate 23 is pivotally mounted on control base 22 and the other end pivotally engages roller 17. The distance between each end pivot of cover plate 23 and the bolt attaching the cover to the bearing cap 20 is equal so that the cage travels half the distance the rotary disc 16 travels when yoke 12 pivots.

By controlling the thickness or rigidity of rotary disc 16, fixed plates 19 and damping plates 21, the elastic deflection of these members, which together form a bearing member, can be influenced in such a way that the bearing force initiated by means of a line contact (hertzian pressure) between tilting yoke 12 and rotary disc 16 is uniformly distributed over all the rollers in the linear roller bearings 18. Plastic damping plates 21 function to prevent the operating noise and vibrations of the pump mechanism from reaching the control base 22.

A pump governor or pressure compensator mechanism 24 has a control piston 25 positioned in control base 22. Piston 25 is a differential piston. Piston 25 is connected to yoke 12 through a fork-shaped yoke 26 which is rigidly affixed to piston 25. Yoke 26 is pivotally attached to a bridge member 28 mounted on the back of yoke 12 through a bolt 27. Thus, axial movement of control piston 25 causes corresponding pivotal movement of yoke 12. A spring in the compensator mechanism 24 biases the control piston 25 to one extreme position in which the yoke is pivoted to the full on-stroke position. When the pressure in the pump outlet exceeds the setting of mechanism 24 the mechanism supplies high pressure fluid to the control piston 25 to move it out of the one extreme position and thereby pivot yoke 12 to a position of reduced displacement until the pressure in the outlet falls to the setting of mechanism 24. A line 36 shown in FIG. 3 supplies high pressure fluid to compensator mechanism 24. Such a pressure conpensator mechanism is more fully described in U.S. Pat. Nos. 2,835,228 and 4,289,452.

Referring against to FIG. 3, it can be seen that the slots 32, 33 in port plate 6 are connected to the suction or exhaust ports in manifold 3. Plastic sleeves 34 are inserted in the ports in manifold 3 to reduce the amount of noise and vibration that is transferred between the manifold and the housing.

Although a preferred embodiment of the invention has been illustrated and described, it will be apparent to those skilled in the art that various modifications may be made without departing from the spirit and scope of the present invention.

What is claimed is:

1. A hydraulic, axial piston machine comprising: a housing, a barrel, means for rotatably mounting the barrel in the housing, a port plate engaged by one end of the barrel, a plurality of equally spaced circumferentially arranged piston bores in the barrel, a plurality of pistons of which one is mounted in each piston bore, a swash plate, wherein one end of each piston is engaged with the swash plate, a yoke, means for mounting the swash plate on the yoke, a pair of trunnions anchored in the housing, means for connecting the yoke to the trunnions, a control base in the housing, means mounted in the control base for pivoting the yoke about the axis of the trunnions, wherein the yoke pivots between a first position of minimum fluid displacement in which the plane of the swash plate is perpendicular to the axis of the barrel and the pistons do not reciprocate when the barrel is rotated and a second position of maximum fluid displacement in which the plane of the swash plate is at a maximum angle with respect to the axis of the barrel and the pistons move a maximum distance when the barrel is rotated, roller bearing means supported in the control base, a rigid disc mounted on the bearing means, a curved surface formed on the rear of the yoke wherein the curved rear surface of the yoke is supported on the disc such that the disc moves linearly as the yoke is pivoted and the load on the swash plate is transmitted through the yoke and the disc to the bearing means.

2. The axial piston machine of claim 1, including a pair of lateral guide arms formed on the yoke, wherein the guide arms slidably engage the trunnions to enable the yoke to pivot about the axis of the trunnions and to move radially with respect to the axis of the trunnions such that the forces acting on the yoke are not transmitted to the trunnions.

3. The axial piston machine of claim 2, wherein the radius of curvature of the curved surface on the back of the yoke has its center point on the axis of the trunnions.

4. The axial piston machine of claim 1, comprising a resilient damping plate interposed between the roller bearing means and the control base to reduce the amount of vibration transmitted from the bearing to the control base.

5. The axial piston machine of claim 4, wherein the roller bearing means includes two symmetrical linear roller bearings and a damping plate is interposed between each bearing and the control base.

6. The axial piston machine of claim 5, including a cage for each roller bearing, a cover plate affixed to the outside of the cage of each roller bearing, and one end of each cover plate is connected to the tilting yoke and the other end of each cover plate is connected to the control base.

7. A hydraulic, axial piston machine comprising: a housing, a barrel, means for rotatably mounting the barrel in the housing, a port plate engaged by one end of the barrel, a plurality of equally spaced circumferentially arranged piston bores in the barrel, a plurality of pistons of which one is mounted in each piston bore, a swash plate, wherein one end of each piston is engaged with the swash plate, a yoke, means for mounting the swash plate on the yoke, a pair of trunnions anchored in the housing, means for connecting the yoke to the trunnions, a control base in the housing, means mounted in the control base for pivoting the yoke about the axis of the trunnions, wherein the yoke pivots between a first position of minimum fluid displacement in which the plane of the swash plate is perpendicular to the axis of the barrel and the pistons do not reciprocate when the barrel is rotated and a second position of maximum fluid displacement in which the plane of the swash plate is at a maximum angle with respect to the axis of the barrel and the pistons move a maximum distance when the barrel is rotated, wherein the means for rotatably mounting the barrel in the housing includes a sleeve which has an inner surface and an outer surface, and the inner surface slidably receives the barrel, a bearing ring having an outer surface which is received in the housing and an inner surface which receives the outer surface of the sleeve, wherein the bearing ring has a plurality of bores formed therein which connected the inner and outer surfaces of the bearing ring and high pressure oil is supplied to the bores to provide a hydrodynamic oil film in a first gap between the inner surface of the bearing and the sleeve and a second gap between the outer surface of the bearing and the housing.

8. The axial piston machine of claim 7, wherein a spring is interposed between the barrel and the sleeve such that the barrel is biased towards the port plate and a first lateral face on the sleeve is biased against a second lateral face on the bearing and wherein lubrication ducts are formed in the sleeve which are inclined in the direction of rotation and direct fluid towards the first and second lateral faces.

9. The axial piston machine of claim 7, wherein the housing is a central tube and the resilient damping ring is interposed between the central tube and a second housing which supports the port plate.

10. The axial piston machine of claim 7, wherein the axis of the trunnions laterally bisects the bearing ring.

11. The axial piston machine of claim 9, wherein the central tube, barrel and other rotating components are enclosed in a non-load bearing spring cap.

12. The axial piston machine of claim 11, including including a coating of a damping material applied to the inner surface of the spring cap to reduce the amount of noise transmitted from the pump.

* * * * *